US005346795A

United States Patent [19]

Pickering et al.

[11] Patent Number: 5,346,795

[45] Date of Patent: * Sep. 13, 1994

[54] TONER AND DEVELOPER COMPOSITIONS

[75] Inventors: Thomas R. Pickering, Webster; Denise R. Bayley, Fairport; Roger N. Ciccarelli, Rochester; Jacques C. Bertrand, Ontario, all of N.Y.

[73] Assignee: Xerox Corporation, Stamford, Conn.

[ * ] Notice: The portion of the term of this patent subsequent to Jun. 29, 2010 has been disclaimed.

[21] Appl. No.: 67,927

[22] Filed: May 27, 1993

[51] Int. Cl.[5] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,264,185 | 4/1981 | Ohta | 118/661 |
| 4,378,415 | 3/1983 | Chu | 430/45 |
| 4,411,974 | 10/1983 | Lu et al. | 430/106 |
| 4,525,447 | 6/1985 | Tanaka et al. | 430/122 |
| 4,656,112 | 4/1987 | Kawagishi et al. | 430/110 |
| 4,845,003 | 7/1989 | Kuriu et al. | 430/110 |
| 4,855,208 | 8/1989 | Tada et al. | 430/110 |
| 4,948,686 | 8/1990 | Koch et al. | 430/45 |
| 5,075,185 | 12/1991 | Bertrand et al. | 430/45 |
| 5,223,368 | 6/1993 | Ciccarelli et al. | 430/110 |

*Primary Examiner*—Roland Martin
*Attorney, Agent, or Firm*—E. O. Palazzo

[57] ABSTRACT

A toner composition comprised of resin, pigment and a mixture of charge enhancing additives comprised of an alkylsalicyclic acid and a charge additive of the formula

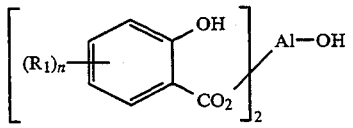

or

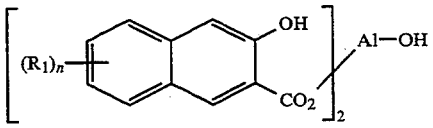

wherein $R_1$ is selected from the group consisting of hydrogen and alkyl, and n is zero, 1, 2, 3, or 4.

28 Claims, No Drawings

TONER AND DEVELOPER COMPOSITIONS

BACKGROUND OF THE INVENTION

The present invention relates to toner and developer compositions, and more specifically to toner compositions comprised of a mixture of charge enhancing additives. In embodiments, the present invention is related to negatively charged toner compositions comprised of resin, pigment, and a mixture of charge additives comprised of an alkylsalicylic acid and the aluminum hydroxide charge enhancing additives, such as aluminum salts of alkylated salicylic acid like, for example, hydroxy bis [3,5-tertiary butyl salicylic] aluminate as illustrated in copending patent application U.S. Ser. No. 755,919, now U.S. Pat. No. 5,223,368, the disclosure of which is totally incorporated herein by reference. Also, the present invention relates to developer compositions comprised of the toners illustrated herein, and carrier particles, including those with a coating thereover. The toners and developers of the present invention can be selected for a number of electrophotographic imaging and printing processes including known xerographic processes. Also, the toners and developers of the present invention can be utilized for color, inclusive of tri-level color xerography, reference U.S. Pat. No. 4,948,686, U.S. Pat. No. 5,208,129, U.S. Pat. No. 5,212,036, full process color, copending patent application U.S. Ser. No. 705,995, now U.S. Pat. No. 5,275,905, the disclosures of which are totally incorporated herein by reference, hybrid scavengeless, conductive magnetic brush, single component magnetic brush, inductive magnetic brush, discharge area development, and the like. In an embodiment, the present invention is directed to imaging processes, a process for forming two*color images, and more specifically, to a process for obtaining two-color images, which in embodiments comprises charging an imaging member, creating on the member a iatent image comprising areas of high, medium, and low potential, developing the low areas of potential with a toner composition, subsequently developing the high areas of potential with a toner composition, transferring the developed image to a substrate, and optionally permanently affixing the image to the substrate. Another embodiment of the present invention relates to processes for obtaining two-color images which comprises charging an imaging member, creating on the member a latent image comprising areas of high, medium, and low potential, developing the low areas of potential with a developer composition comprised of a negatively charged toner with a mixture of charge additives comprised of di-tertiary-butylsalicylic acid and aluminum hydroxide charge enhancing additives, such as the aluminum salts of alkylated salicylic acid or the hydrates thereof, subsequently developing the high areas of potential with a developer composition comprised of a colored toner, especially a blue toner containing a second charge enhancing additive, transferring the developed images to a substrate, and permanently affixing the images to the substrate by, for example, heat or a combination of heat and pressure. One advantage associated with the imaging processes of the present invention is the ability to generate high quality two-color images in a single development pass, particularly as a result of the absence of interaction between the colored, excluding black, and the black developers in an embodiment of the present invention. Other advantages associated with the present invention include the provision of a developer with substantially stable negative triboelectical toner characteristics and stable negative triboelectrically charged toner which enables the generation of high quality images subsequent to development, that is images with substantially no background deposits and substantially no smearing for a broad range of relative humidity conditions, that is for example from between about 20 to 90 percent relative humidity at an effective range of, for example, temperature zones ranging, for example, from between about 20° C. to about 80° C. Also, with the developers of the present invention undesirable bead carry out is avoided or minimized. Bead carry out can occur when carrier beads are developed onto the photoreceptor, and these beads occupy areas of the image that should have toner, thus causing deletions in the fused image.

The charge additives of the present inventions can be obtained by the reaction of two equivalents of the sodium salt of, for example, 3,5-di-tert-butyl salicylic acid with one half equivalent of a dialuminum salt, for example aluminum sulfate, $Al_2(SO_4)_3$, in an aqueous alkali solution which generates a compound of two salicylic acid molecules about a single central aluminum atom wherein both carboxylate groups of the salicylic acid moleties are covalently bonded through the carboxylate oxygen atom to the aluminum atom. It is also believed that the hydroxy aluminum complex compounds of the present invention have a hydroxyl group (—OH) that is covalently-bonded to the aluminum atom (Al), that is an Al —OH. Also, the aromatic hydroxyl groups of the salicylic acid may be datively coordinated rather than covalently bonded to the central aluminum atom. The degree of hydration of the hydroxy aluminate complexes may vary as indicated by the subscript x and may be equal to 0, 1, 2, 3, or 4, and may depend upon how vigorously the complex is dried after isolation. It is further believed that the hydroxy aluminate complexes when formed with the processes as illustrated herein in embodiments can form mixtures, The water of hydration is believed to be strongly associated with the aluminum atom and is not easily removed upon heating under vacuum for 24 hours at 100° C. and above. Further, although not being desired to be limited to theory it is believed in embodiments that the negative charge enhancing ability of hydroxy aluminate complexes may derive negative charge directing ability from both the covalently bound hydroxyl group and the water of hydration. These structural features may serve to stabilize the complex and also serve as a reservoir of readily exchangable protons.

As a second charge additive there can be selected, for example, ditertiary-butylsalicyclic acid.

Toners with certain aluminum charge enhancing additives are known, reference U.S. Pat. No. 4,845,003, the disclosure of which is totally incorporated herein by reference. The charge additives of the aforementioned patent comprise an aluminum compound of a hydroxycarboxylic acid which may be substituted with alkyl and/or aralkyl, reference the Abstract for example. Infrared analysis of a number of the aluminum charge enhancing additives of the '003 patent indicates the presence of free 3,5-di-t-butylsalicylic acid in significant amounts. Infrared analysis of the aluminum hydroxide charge additive of the present invention indicates that no free acid, or substantially no free acid is present.

Toners with charge enhancing additives including additives that assist in providing a negative charge to the toner, such as orthohalocarboxylic acids, certain metal complexes and the like, are known. Also known are positively charged toners, reference for example U.S. Pat. Nos. 4,298,672; 4,338,390 and 4,560,635, the disclosure of which are totally incorporated herein by reference.

In a patentability search report for U.S. Ser. No. 755,919 now U.S. Pat. No. 5,223,368, the following U.S. Pat. No. were recited: 4,845,003 discussed herein; U.S. Pat. No. 4,656,112, which discloses, for example, toners with a zinc complex compound of an aromatic hydroxycarboxylic acid with or without a substituent as a charge agent, see the Abstract, and column 2; and as background interest 4,411,974.

Processes for obtaining electrophotographic, including xerographic, and two-colored images are known. In U.S. Pat. No. 4,264,185, the disclosure of which is totally incorporated herein by reference, there is illustrated an apparatus for forming two-color images by forming a bipolar electrostatic image of a two-color original document on a photoconductive drum. A first developing unit applies a toner of a first color and polarity to the drum and a second developing unit applies a toner of a second color and polarity to the drum to form a two-color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner.

In U.S. Pat. No. 4,308,821, there is disclosed a method and apparatus for forming two-color images which employs two magnetic brushes. The first developed image is not disturbed during development of the second image since the second magnetic brush contacts the surface of the imaging member more lightly than the first magnetic brush, and the toner scraping force of the second magnetic brush is reduced in comparison with that of the first magnetic brush by setting the magnetic flux density on a second nonmagnetic sleeve with an internally disposed magnet smaller than the magnetic flux density on a first magnetic sleeve, or by adjusting the distance between the second nonmagnetic sleeve and the surface of the imaging member. In addition, the toners selected may have different quantities of electric charge.

Further, U.S. Pat. No. 4,378,415, the disclosure of which is totally incorporated herein by reference, illustrates a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles. In U.S. Pat. No. 4,430,402, there is illustrated a two-component type dry developer for use in dichromatic electrophotography which comprises two kinds of developers, each of which are comprised of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

Additionally, U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner.

In addition, U.S. Pat. No. 4,500,616 discloses a method of developing electrostatic latent images by selectively extracting colored grains of one polarity from a mixture containing colored grains havinq opposite polarity to each other in the presence of an alternating field, followed by development of the electrostatic image by the selectively extracted colored grains. Further, U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer. The photoreceptor surface is then subjected to a reversal development treatment by the use of a photoconductive color toner charged with the same polarity as the electric charges constituting the latent image to develop the noncharged region with the photoconductive toner. The latent image is then subjected to normal development treatment with an insulative toner having a color different from the color of the photoconductive toner. Subsequently, the color toners on the photoconductive layer are charged with a different polarity from the charging polarity and, simultaneously, the original is exposed through a filter shielding against the first color, thereby forming a two-colored image.

Furthermore, in U.S. Pat. No. 4,525,447, the disclosure of which is totally incorporated herein by reference, there is illustrated an image forming method which comprises forming on a photosensitive member an electrostatic latent image having at least three different levels of potentials, or comprising first and second latent images and developing the first and second latent images with a three component developer. The developer comprises a magnetic carrier, a first toner chargeable to one polarity by contact with the magnetic carrier, and a second toner chargeable to a polarity opposite to that of the first toner by contact with the first toner, but substantially not chargeable by contact with the magnetic carrier. Also, U.S. Pat. No. 4,539,281 discloses a method of forming dichromatic copy images by forming an electrostatic latent image having a first image portion and a second image portion. The first image portion is developed by a first magnetic brush with a magnetic toner of a first color that is chargeable to a specific polarity, and the second image portion is developed by a second magnetic brush with a mixture of a magnetic carrier substantially not chargeable with the magnetic toner and a nonmagnetic toner of a second color chargeable to a polarity opposite to that of the magnetic toner by contact with the magnetic carrier.

Additionally, U.S. Pat. No. 4,562,129, the disclosure of which is totally incorporated herein by reference, illustrates a method of forming dichromatic copy images with a developer composed of a high-resistivity magnetic carrier and a nonmagnetic insulating toner, which are triboelectrically chargeable. An electrostatic latent image having at least three different levels of potential is formed and the toner and carrier are adhered, respectively, onto the first and second image portions. In addition, U.S. Pat. No. 4,640,883, the disclosure of which is totally incorporated herein by reference, illustrates a method of forming composite or dichromatic images which comprises forming on an imaging member electrostatic latent images having at least three different potential levels, the first and second latent images being represented, respectively, by a first potential and a second potential relative to a common background potential.

The following United States patents are mentioned: U.S. Pat. No. 4,845,004 directed to hydrophobic silicon type micropowders comprising silicon type microparticles which have been treated with secondary tertiary amine functional silanes, and when the micropowders combine with the positively charging resin powder, such as a toner, the fluidity of the resin powder is substantially increased, see for example the Abstract of the Disclosure, column 1, beginning at line 60, and continuing on to column 4, and the working Examples; U.S. Pat. No. 4,758,491 directed to dry toner and developer compositions with good charge stability and minimization of toner image transfer defects, which composition comprises a major component of a normally solid fixable binder resin which is free of siloxane segments and is a minor component in a normally solid multiphase thermoplastic condensate polymer which contains a polyorgano siloxane block or graft segment, note specifically the use of a charge control agent in column 2, beginning at line 50, examples of charge control agents being detailed, for example, in column 4, beginning at line 23, including ammonium or phosphonium salts, and the like; U.S. Pat. No. 4,845,003, mentioned herein, directed to a toner for developing electrostatic latent images characterized in that the toner comprises an aluminum compound of a hydroxy carboxylic acid which may be substituted with alkyl and/or arylalkyl, see for example column 2, beginning at line 29, and continuing on to column 5, it being noted that the aluminum complex compounds of this patent may be selected as the charge enhancing additive component for one of the developer compositions of the present invention comprised of resin pigment, excluding black, the disclosure of this patent being totally incorporated herein by reference; and U.S. Pat. No. 4,855,208 directed to a toner for developing electrostatic latent images, which toner comprises an aluminum compound of an aromatic amino carboxylic acid as represented by the formula illustrated in the Abstract of the Disclosure, and also see column 2, beginning at line 26, and continuing on to column 7. The aluminum compound of the '208 patent may be selected in an embodiment as a charge enhancing additive for the colored toner and developer, that is developer without black pigment, of the present invention.

Other representative patents of interest with respect to formation of two-color images include U.S. Pat. No. 4,045,218 and U.S. Pat. No. 4,572,651.

The process of charging a photoresponsive imaging member to a single polarity and creating on it an image consisting of at least three different levels of potential of the same polarity is described in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the trilevel process for generating images is U.S. Pat. No. 4,686,163, the disclosure of which is totally incorporated herein by reference.

Illustrated in U.S. Pat. No. 4,948,686, the disclosure of which is totally incorporated herein by reference, is a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about I to about 15 percent by weight and selected from the group consisting of copper phthalocyanine pigments, quinacridone pigments, azo pigmerits, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate. Imaging members suitable for use with the process of the copending application may be of any type capable of maintaining three distinct levels of potential. Generally, various dielectric or photoconductive insulating material suitable for use in xerographic, ionographic, or other electrophotographic processes may be selected for the above process, and suitable photoreceptor materials include amorphous silicon, layered organic materials as disclosed in U.S. Pat. No. 4,265,990, the disclosure of which is totally incorporated herein by reference, and the like.

Toners with certain zinc or aluminum salicylate complex charge enhancing additive in admixture with a second non metal containing charge enhancing additive are illustrated in copending application U.S. Ser. No. 755,979, the disclosure of which is totally incorporated herein by reference. The toner compositions of the aforementioned patent application contain, for example, a mixture of a zinc 3,5-di-tert-butyl salicylate compound and an alkyl pyridinium halide compound as the charge control additive mixture, a resin, a colorant, a colloidal silica external additive, and a metal salt of a fatty acid external additive.

A developer composition with a toner containing a resin, a colorant, a charge control agent, and colloidal silica external additive particles and a carrier with a core, an optional coating on the core, and an external additive selected from the group consisting of metal salts of fatty acids, linear polymeric alcohols comprising a fully saturated hydrocarbon chain with at least about 80 percent of the polymeric chains terminated at one end with a hydroxyl group are illustrated in U.S. Pat. No. 5,171,653, the disclosure of which is totally incorporated herein by reference. The charge control additives of the aforementioned patent include, for example, dimethyl distearyl ammonium methyl sulfate.

In U.S. Pat. No. 5,075,185, the disclosure of which is totally incorporated herein by reference, there is illustrated a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black:, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto. In an embodiment of the copending application, the first developer comprises, for example, a first toner comprised of resin present in an effective amount of from, for example, about 70 to about 98 percent by weight, which resin can be selected from the group consisting of polyesters, styrene-butadiene polymers, styrene-acrylate polymers, styrenemethacrylate polymers, PLIOLITES®, crosslinked styrene acrylates, crosslinked styrene methacrylates, and the like wherein the crosslinking component is, for example, divinyl benzene, and mixtures thereof; a first colored blue, especially PV FAST BLUE®, pigment present in an effective amount of from, for example, about 1 to about 15 percent by weight, and preferably from about 1 to about 3 weight percent; an aluminum complex charge enhancing additive, such as those illustrated in the '003 patent; and a second developer comprised of a second toner comprised of resin present in an effective amount of from, for example, about 70 to about 98 percent by weight, which resin can be selected from the group consisting of polyesters, styrene-butadiene polymers, styrene-acrylate polymers, styrenemethacrylate polymers, PLIOLITES®, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about I to about 5 weight percent wherein the aforementioned black toner contains a charge enhancing additive such as an alkyl pyridinium halide, and preferably cetyl pyridinium chloride; and in a preferred embodiment the black toner is comprised of 92 percent by weight of a styrene n-butyl methyacrylate copolymer (58/42), 6 percent by weight of REGAL 330® carbon black, and 2 percent by weight of the charge enhancing additive cetyl pyridinium chloride. The aforementioned toners may include as surface or external components additives in an effective amount of, for example, from about 0.1 to about 3 weight percent, such as colloidal silicas, metal salts, metal salts of fatty acids, reference for example U.S. Pat. Nos. 3,590,000; 3,655,374; 3,900,588 and 3,983,045, the disclosures of which are totally incorporated herein by reference, metal oxides and the like for the primary purpose of controlling toner conductivity and powder flowability.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging member selected. Similar imaging processes are envisioned for the toners and developers of the present invention.

Illustrated in copending patent applications U.S. Ser. No. 894,688, now U.S. Pat. No. 5,275,900, which discloses a negatively charged toner composition comprised of a polymer or polymer resins, a colorant or colorants, optional surface additives, and a metal complex charge enhancing additive obtained from the reaction of a hydroxybenzoic acid and a base with a mixture of a metal ion and a hydroxyphenol; U.S. Ser. No. 894,690, now U.S. Pat. No. 5,300,387, which discloses a negatively charged toner composition comprised of a polymer or polymers, a colorant or colorants, optional surface additives, and a metal complex charge enhancing additive obtained from the reaction of a hydroxybenzoic acid and a base with a mixture of a metal ion and an aromatic dicarboxylic acid; U.S. Ser. No. 898,610, now U.S. Pat. No. 5,238,768, which discloses a negatively charged toner composition comprised of resin particles, colorants, optional surface additives, and a dihydroxyaryl sulfone charge enhancing additive, or an unsymmetrical hydroxyaryl sulfone charge enhancing additive obtained from the condensation of sulfuric acid with a molar equivalent of a phenol, followed by condensation with a second phenol, or from the condensation of an aromatic sulfonic acid with a phenol; U.S. Ser. No. 964,544, which discloses a toner composition comprised of polymers, pigment particles and/or dyes, optional surface additives, and a charge enhancing additive derived from the reaction of a metal, a metal carbonyl, a metal salt, or a metal oxide, with a $\beta$-diketone, a $\beta$-keto ester, or a malonic ester in an aqueous medium or organic medium; U.S. Ser. No. 964,541, now U.S. Pat. No. 5,290,651, which discloses a negatively charged toner composition comprised of a polymer resin or polymer resins, colorants comprised of pigment particles and/or dyes, optional surface additives, and a nonionic zinc complex charge enhancing additive containing two different ligands derived from an orthohydroxyphenol and an ortho-hydroxybenzoic acid; U.S. Ser. No. 978,572, now U.S. Pat. No. 5,256,515, which discloses a negatively charged toner composition comprised of resin particles, pigment particles, optional surface additives, and a halogenated salicyclic acid complex charge enhancing additive of the following formula:

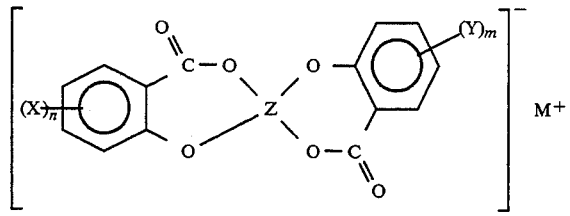

wherein Z is zinc or chromium; M is hydrogen, an alkali metal, an alkaline earth metal, $NH_4$, or $NR_4$ wherein R is alkyl; X and Y are independently selected from the group consisting of chloride, iodide and bromide; and n and m are the numbers 1 or 2; U.S. Ser. No. 978,584, now U.S. Pat. No. 5,256,514, which discloses a negatively charged toner composition comprised of resin particles, pigment particles, optional surface additives, and a halogenareal salicylic acid charge enhancing additive of the following formula

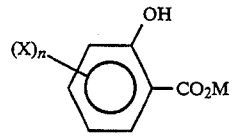

wherein X is halogen, M is hydrogen, an alkaline earth, an alkali metal, or $NR_4$ wherein R is alkyl, and n is the number 1 or 2; and U.S. Ser. No. 978,571, now U.S. Pat. No. 5,300,389, which discloses a negatively charged toner composition comprised of resin particles, pigment particles, optional surface additives, and a halogenated aluminum salicylic acid complex charge enhancing additive of the following formulas

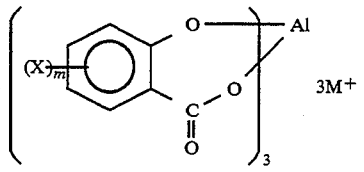

or

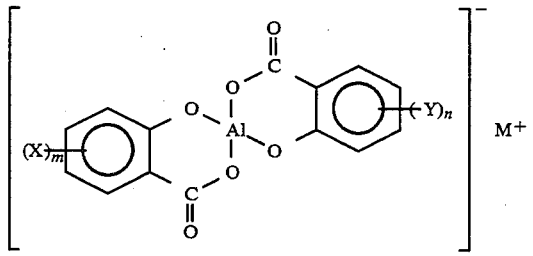

wherein M is hydrogen, an alkali metal, an alkaline earth metal, $NH_4$, or $NH_4$ wherein R is alkyl; X and Y are independently selected from the group consisting of iodide, chloride and bromide, and n and m are the numbers 1 or 2, the disclosures of which are totally incorporated herein by reference.

SUMMARY OF THE INVENTION

It is a object of the present invention to provide toner and developer compositions.

In another object of the present invention there are provided negatively charged toners.

Another object of the present invention resides in the provision of toners with a mixture comprised of certain aluminum charge enhancing additives and an alkylsalicyclic acid.

It is another object of the present invention to provide toners comprised of resin, pigment, and charge additives comprised of a mixture of the aluminum salts of alkylated salicylic acid, the hydrates, such as the mono, di, tri and tetrahydrates thereof, or the nonhydrates thereof, and di-tertiary-butylsalicylic acid.

These and other objects of the present invention can be accomplished by the provision of toners with certain charge enhancinq additives. More specifically, the present invention is directed to a toner comprised of resin, pigment particles, and a charge additive mixture comprised of a first charge additive of an alkylsalicylic acid, wherein alkyl contains, for example, from 1 to about 12 carbon atoms, such as di-tertiary-butylsalicylic acid, and a second charge additive as represented by the formulas presented, or mixtures thereof in embodiments. In one embodiment, the toner of the present invention is comprised of resin, pigment and a mixture of charge additives one of which is a charge enhancing additive of the formulas as represented by

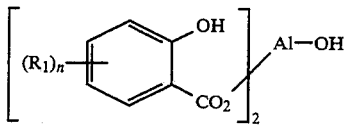

or

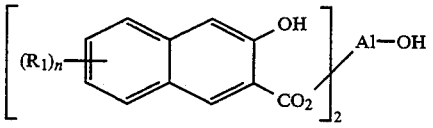

wherein $R_1$ is hydrogen, alkyl with, for example, from 1 to about 25 carbon atoms as illustrated herein and the like, and n represents the number of $R_1$ groups, and can be zero, 1, 2, 3, or 4.

Embodiments of the present invention include a toner wherein $R_1$ is hydrogen, methyl, ethyl, propyl, butyl, or pentyl, and n is 0 (zero), 1, 2, 3, or 4; and wherein $R_1$ is hydrogen, isopropyl, n-butyl, isobutyl, or tertbutyl and n is 0 (zero), 1, 2, 3, or 4. Also, the present invention relates to developers comprised of the toners illustrated herein, and carrier particles comprised of a core, like steel, ferrites, such as copper zinc ferrites, and the like, and which core may optionally contain thereover a polymeric coating, or mixture of polymers.

The toners of the present invention in embodiments thereof are comprised of resin particles, pigment particles, such as known carbon blacks, including those available from Cabot Corporation, such as REGAL 330 ®carbon black, colored pigments other than black such as magenta, cyan, yellow, red, blue, green, brown, or mixtures thereof, and the charge additive mixture illustrated herein, and which mixture can be incorporated into the toner, be present on the toner surface, or be added to a flow aid component that is then added to the toner surface.

Examples of one specific charge additive selected for the toners of the present invention include hydroxy bis[3,5-tertiary butyl salicylic] aluminate; hydroxy bis[3,5-tertiary butyl salicylic] aluminate toorio-, di-, tri-or tetrahydrates; hydroxy his[salicylic] aluminate; hydroxy bis[monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains I to about 6 carbon atoms; bis[trialkylated hydroxy naphthoic acid] aluminate wherein alkyl preferably contains 1 to about 6 carbon atoms; bis[tetraalkylated hydroxy naphthoic acid] aluminate wherein alkyl preferably contains 1 to about 6 carbon atoms; and the like.

Examples of alkyisalicylic acids present in the mixture in embodiments include di-tertiary-butylsalicylic acid; di-isopropylsalicylic acid; di-alkylsalicylic acid wherein alkyl preferably contains 1 to about 6 carbon atoms, and the like. The ratio ofthe mixture should be in the range of 4 parts charge additive to 1 part alkylsalicylic acid to about 1 part charge additive to 4 parts alkylsalicylic acid and preferably from 1:1 (charge additive :alkylsalicylic acid) to 3:2.

The charge additive mixture is present in the toner in various effective amounts, for example from about 0.05 to about 20, and preferably from about 1 to about 5 weight percent. The charge additive mixture of the present invention may in embodiments also be added to the surface of the toner particles or may be included on the toner particles by adding the mixture onto the surface of small particle metal oxide particles, for example silicon oxides, tin oxides, aluminum oxides, zinc oxides, cerium oxides, titanium oxides, and the like. The toner can possess a negative triboelectic charge of from about 10 to about 40, and preferably from about 10 to about 25 microcoulombs per gram as determined by the known Faraday Cage process.

The aluminum hydroxide charge additives of the present invention in embodiments, reference for example the compounds of the formulas, can be prepared by the reaction of at least two molar equivalents of the sodium or alkali sait of a salicylic acid derivative wherein $R_1$ is hydrogen or alkyl, with for example from 1 to about 25 carbon atoms as illustrated herein, and wherein n represents the number of $R_1$ groups, and can be zero, 1, 2, 3, or 4 with a one molar aluminum equivalent of an aluminum containing salt, for example using a dialuminum salt such as aluminum sulfate, $Al_2(SO_4)_3$ being about one half molar equivalent. The aluminum salt reactant may be a hydrated compound, for example $Al_2(SO_4)_3.XH_2O$ and wherein X represents the number of water components such as 0 to about 25. The reaction sequence is preferably accomplished by first converting an alpha hydroxy carboxylic acid compound, that is a salicylic acid derivative, for example, when converting the formula into the corresponding alkali metal salt, for example sodium, in an aqueous alkali solution. The aqueous alkali solution containing the alkali salt of the alpha hydroxy carboxylate is then added to an acidic aqueous solution containing the aluminum containing salt reactant with rapid stirring. This inverse addition ensures that the complexing aluminum species is initially present in excess relative to the concentration of the added sodium salt. The inverse addition also avoids or minimizes tris-complex formation, $[RCO_2]_3Al$, that is a product having three carboxylate containing ligands bonded to the aluminum atom and no hydroxyaluminum bond. The reaction produces a precipitate that may be collected by filtration after cooling. The crude product may be purified further by washing with, for example, water or other suitable nonsolvents until the acidity of the wash water is nearly constant, for example a pH of about 5.5. The product is preferably dried to a constant weight in a vacuum drying oven. The reaction can provide a 2:1 complex of two salicylic acid molecules arranged about a single central aluminum atom wherein both carboxylate groups of the salicylic acid moleties are covalently bonded through the carboxylate oxygen atom to the aluminum atom, It is also believed that the hydroxy aluminum compounds prepared in this manner have a hydroxyl group (—OH) that is covalently bonded to the aluminum atom.

A similar reaction procedure can be selected to prepare hydroxy aluminate compounds corresponding to the formula except that the reactant alpha hydroxy carboxylic acid compound is selected from alpha hydroxy naphthoic acid or substituted alpha hydroxy naphthoic acid compounds wherein the substituent $(R_1)_n$ is hydrogen or alkyl with, for example, from 1 to about 25 carbon atoms, and n represents the number of $R_1$ groups, and can be zero, 1,2, 3, or 4.

The following reaction sequence illustrates the preparation of the aluminum hydroxide charge control additive of the present invention wherein the $RCO_2H$ represents the aforementioned salicylic acid or alpha hydoxy naphthoic acid derivative reactants containing the substituent $(R_1)_n$ that are neutralized with base to form the corresponding alkali melt salt of the carboxylic acid, $RCO_2Na$ $$4RCO_2H+6NaOH\rightarrow 4RCO_2Na+4H_2O$$

$$4RCO_2Na+2NaOH+Al_2(SO_4)_3\rightarrow 2(RCO_2)_2\text{—}Al\text{—}OH+3Na_2SO_4$$

where $RCO_2H$ is a salicylic acid derivative, for example 3,5-di-tert-butyl salicylic acid, salicylic acid, alkylated salicylic acid, hydroxy naphthoic acid, alkylated hydroxy naphthoic acid, and the like. The salicylic acid may contain one or more substituents $R_1$, reference the formula illustrated herein, wherein $R_1$ is hydrogen or alkyl, and preferably methyl, ethyl, n-propyl, isopropyl, n-butyl, isobutyl, tert-butyl, $C_5$ alkyl and isomers thereof, and $C_6$ alkyl to $C_{20}$ alkyl and isomers thereof; and n is 0 to 4. $R_1$ can be comprised of a mixture of the groups indicated, especially when n is 2 to 4. The reaction may be performed at effective elevated temperatures, for example greater than about 40° C., and preferably at about 60° C., or at room temperature, about 25° C. The initially formed salicylic acid sodium salt can be added to the aluminum sulfate solution which allows the aluminum to remain in excess during the reaction. The acidity or pH of the reaction mixture may be followed during the reaction and increases from about 2 to about 3 and levels off at about 5.5 when the reaction is complete. The yield of the reaction was about 95 percent based on the weight of the aluminum salt used. Infrared analysis of the products indicated that no free salicylic acid derivative was present; that is, only the hydroxy aluminum compiex was present in the product.

The other charge additive, such as di-tertiary-butylsalicylic acid, present in the charge additive mixture is commercially available from Daiei Chemical Company Ltd., Japan.

The toner compositions of the present invention can be prepared by a number of known methods such as admixing and heating polymer resins such as styrene butadiene copolymers, colorants such as color pigment particles or dye compounds, and the aforementioned metal salt charge enhancing additive, or mixtures of charge additives in a concentration preferably ranging from about 0.5 percent to about 10 percent in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 5 to about 25 microns, and preferably from about 5 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; polyurethanes; polyamides and polyimides; polyesters; and the like. The polymer resins selected for the toner compositions of the present invention include homopolymers or copolymers of two or more monomers. Furthermore, the above-mentioned polymer resins may also be crosslinked depending on the desired toner properties. Illustrative vinyl toohomer units in the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference; polyester resins obtained from the reaction of bisphenoi A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Ser. No. 814,641, and U.S. Ser. No. 814,782, now U.S. Pat. No. 5,227,460, the disclosures of which are totally incorporated herein by reference, can be selected as toner resins. Other specific toner resins include styrene-methacrylate copolymers, and styrenebutadiene copolymers; PLIOLITES ®; suspension polymerized styrenebutadienes, reference U.S. Pat.

No. 4,558,108, the disclosure of which is totally incorporated herein by reference. Also, waxes with a molecular weight of from about 1,000 to about 7,000, such as polyethylene, polypropylene, and paraffin waxes, can be included in, or on the toner compositions as fuser roll release agents.

The polymer resins are present in a sufficient, but effective amount, for example from about 30 to about 95 weight percent. Thus, when 1 percent by weight of the charge enhancing additive is present, and 10 percent by weight of colorant, such as carbon black or color pigment, is contained therein, about 89 percent by weight of resin is selected. Also, the charge enhancing additive of the present invention may be applied on the surface of the toner particles. When used on the surface, the charge enhancing additive of the present invention is present in an amount of from about 0.05 weight percent to about 5 weight percent, and preferably from about 0.1 weight percent to about 1.0 weight percent.

Numerous well known suitable color pigments or dyes can be selected as the colorant for the toner compositions including, for example, carbon black like REGAL 330®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 0.1 weight percent to about 20 weight percent, and preferably from about 1 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 70, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas, such as AEROSIL®, $TiO_2$, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the metal charge additives of the present invention illustrated herein in an amount of from about 1 to about 50 weight percent and preferably 10 weight percent to about 25 weight percent followed by the addition thereof to the toners in an amount of from 0.1 to 10, and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Included within the scope of the present invention are colored toner and developer compositions comprised of toner resins, optional carrier particles, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the aluminum charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as colorants include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity themselves via frictional charging against the toner particles of the present invention. The opposite charge polarities of the carrier and toner particles of the developer composition enable the toner particles to adhere and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from between about 60 and 200 microns in volume average diameter thereby permitting them, for example, to possess sufficient density and inertia to avoid adherence to the electrostatic images during the development process. The carrier component can be mixed with the toner composition in various suitable combinations, such as from about 1 to about 7 parts of toner to about 100 parts to about 200 parts by weight of carrier.

The toner composition of the present invention can be prepared by a number of known methods including extrusion melt blending the toner resins, colorants, and the metal charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive-treated surface additives such as colloidal silicas. Further, other methods of preparation for the toner are as illustrated herein.

The toner and developer compositions of the present invention may be selected for use in electrostatographic imaging apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 5 to about 25 microns, and more preferably from about 5 to about 12 microns. The triboelectric charging rates for the toners of the present invention are preferably less than 120 seconds and, more specifically, less than 60 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

Other specific resins, pigments, toner additives and carrier components not specifically mentioned herein may also be selected for the toner and developer compositions of the present invention in embodiments.

Specific embodiments of the invention will now be described in detail. These Examples are intended to be illustrative, and the invention is not limited to the materials, conditions, or process parameters set forth in these embodiments. All parts and percentages are by weight unless otherwise indicated, A comparative Example is also provided.

EXAMPLE I

Synthesis of Hydroxy Bis[3,5-Tertiary Butyl Salicy] Aluminate Monohydrate at Elevated Temperature To a solution of 12 grams (0.3 mole) NaOH in 500 milliliters of water were added 50 grams (0.2 mole) of di-tert-butyl salicylic acid. The resulting mixture was heated to 60° C. to dissolve the acid. A second solution was prepared from dissolving 33.37 grams (0.05 mole) of aluminum sulfate, $Al_2(SO_4)_3.18H_2O$, into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid product was washed with water until the acidity of the used wash water was about 5,5. The product was dried for 16 hours in a vacuum oven at 110° C. to afford 52 grams (0.096 mole, 96 percent theory) of a white powder of the above monohydrate, melting point of $>300°$ C. When a sample of the product obtained was analyzed for water of hydration by Karl-Fischer titration after drying for an additional 24 hours at 100° C. in a vacuum, the sample contained 2.1 weight percent of water. The theoretical value calculated for a monohydrate is 3.2 weight percent of water.

Infrared spectra of the above product hydroxy bis[3,5-tertiary butyi salicylic] aluminate monohydrate indicated the absence of peaks characteristic of the starting material di-tert-butyl salicylic acid and indicated the presence of a Al—OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above prepared monohydrate.

Elemental Analysis Calculated for:

$C_{30}H_{41}O_7Al$: C, 66.25; H, 7.62; Al, 5.52.

Calculated for:

$C_{30}H_{41}O_7Al.1H_2O$: C, 64.13; H, 7.74; Al, 4.81.

Found: C, 64.26; H, 8.11; Al, 4.67.

EXAMPLE II

A toner was prepared as follows: 92.5 parts (or percent by weight) of styrene/butadiene copolymer (91/9), 4.5 parts of PV FAST BLUE ® pigment obtained from Hoechst Celanese and 3 parts of the hydroxy aluminum compound obtained by the process of Example I were melt blended in an extruder followed by micronization and air classification to yield toner sized particles of 10 microns in volume average diameter as determined by a Coulter Counter. Carrier particles were prepared by solution coating a Hoeganoes Anchor Steel core with a particle diameter range of from about 75 to about 150 microns, available from Hoeganoes Company, with 1 part by weight of a coating comprising 20 parts by weight of VULCAN ® carbon black, available from Cabot Corporation, homogeneously dispersed in 80 parts by weight of polymethylmethacrylate, which coating was solution coated from toluene. A developer was prepared by taking 3 parts of the above prepared toner and blending it with 100 parts of the above prepared carrier by roll milling for a period of about 30 minutes which resulted in a developer with a toner exhibiting a triboelectric charge of −20.7 microcoulombs per gram as measured in a Faraday Cage, and had a 15 second admix.

EXAMPLE III

The developer of Example II was incorporated in a Xerox Model 5028 machine fixture and operated in a continuous throughput mode for a period of about 29 hours producing in excess of 200,000 prints. The developer composition exhibited excellent tribo stability throughout the test, that is tribo values were in the range of about 20 to 25, and background deposits on the photoreceptor were very low as determined by optical density measurements obtained from Scotch tape transfer of residual wrong sign toner material remaining on the photoreceptor. There was observed virtually no residual toner on the photoreceptor, that is an optical density of less than about 0.01 was measured with a densitometer on the transfer tape. The tape transfer did, however, show that a significant amount of bead carry-out was occuring, that is carrier beads were being developed out on the photoreceptor in the image with the toner, which results in undesirable image deletions.

EXAMPLE IV(a)

A toner was prepared as in Example II except that 3 parts of 3,5-di-t-butylsalicylic acid purchased from Daiei Chemical Company Ltd., Japan was used instead of the hydroxy aluminum compound obtained by the process of Example I. A developer was prepared as described in Example II and roll milling for a period of about 30 minutes resulted in a developer with a toner exhibiting a triboelectric charge of −17.1 microcoulombs per gram as measured in a Faraday Cage, and this toner did not admix until 60 seconds. During extrusion, the vacuum parts become clogged with the above acid and the extruder was rendered inoperable.

EXAMPLE IV(b)

A toner was prepared as in Example IV(a) except that 1 part of 3,5-di-t-butylsalicylic acid and 94.5 parts of styrene/butadiene copolymer (91/9) were used. A developer was prepared as described in Example II and roll milling for a period of about 30 minutes resulted in a developer with a toner exhibiting a triboelectric charge of −10.91 microcoulombs per gram as measured in a Faraday Cage, and an admix time of a time greater than 60 seconds.

EXAMPLE V

The developer of Example IV (a) was incorporated in a Xerox Corporation Model 5028 machine fixture and operated in a continuous throughput mode for a period of about 34 hours producing in excess of 200,000 prints. The developer composition exhibited excellent tribo stability throughout the test, that is tribo values were in the range of about 34 to 37, and background deposits on the photoreceptor were very low as determined by optical density measurements obtained from Scotch tape transfer of residual wrong sign toner material remaining on the photoreceptor. There was observed virtually no residual toner on the photoreceptor, that is an optical density of less than about 0.01 was measured with a densitometer on the transfer tape. No bead carry-out was observed during this machine test.

EXAMPLE VI

A toner was prepared as in Example IV (a) except that a combination of 1 part of 3,5-di-t-butylsalicylic acid and 2 parts of the hydroxyaluminum compound prepared in Example I were used instead of the 3,5-di-t-butylsalicylic acid alone. A developer was prepared as described in Example II and roll milling for a period of about 30 minutes resulted in a developer with a toner exhibiting a triboelectric charge of −30.1 microcoulombs per gram as measured in a Faraday Cage. The toner had an admix of 15 seconds as determined in a charge spectrograph, and the extruder ports remained unplugged during the toner preparation.

EXAMPLE VII

The developer of Example VI was incorporated in a Xerox Corporation Model 5028 machine fixture and operated in a continuous throughput mode for a period of about 12 hours producing in excess of 100,000 prints. The developer composition exhibited excellent tribo stability throughout the test, that is tribo values were in the range of about 38 to 42, and background deposits on the photoreceptor were very low as determined by optical density measurements obtained from Scotch tape transfer of residual wrong sign toner material remaining on the photoreceptor. There was observed virtually no residual toner on the photoreceptor, that is an optical density of less than about 0.01 was measured with a densitometer on the transfer tape. No bead carry-out was observed during this machine test. This combination of the acid with the hydroxy aluminum compound results in an improvement in both higher tribo values and the absence of bead carry-out.

Also, a toner, such as that of Example V, had a higher At, 160, than a similar toner where the charge additive was 3,5-di-t-butylsalicylic acid alone, 140, the aluminate of Example I alone, 100, or BONTRON E-88 ®, an aluminum complex available from Orient Chemicals, 125.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner composition comprised of resin, pigment and a mixture of charge enhancing additives comprised of an alkylsalicyclic acid and a charge additive of the formula

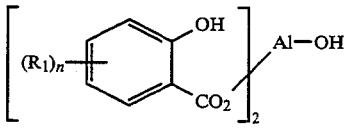

or

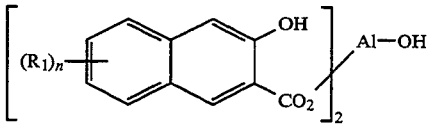

wherein $R_1$ is selected from the group consisting of hydrogen and alkyl, and n is zero, 1,2, 3, or 4.

2. A toner in accordance with claim 1 wherein alkyl contains from 1 to about 25 carbon atoms.

3. A toner in accordance with claim 1 wherein $R_1$ is hydrogen, methyl, ethyl, propyl, or butyl, and the alkylsalicyclic acid is di-tertiary-butylsalicyclic acid.

4. A toner in accordance with claim 1 wherein $R_1$ is hydrogen, isopropyl, n-butyl, isobutyl, or tert-butyl, and the alkylsalicyclic acid is di-tertiary-butylsalicyclic acid.

5. A toner composition comprised of resin, pigment and a charge additive mixture comprised of an alkylsalicyclic acid and a hydroxy aluminum complex charge enhancing additive of the formula as represented by

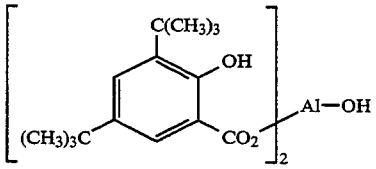

or

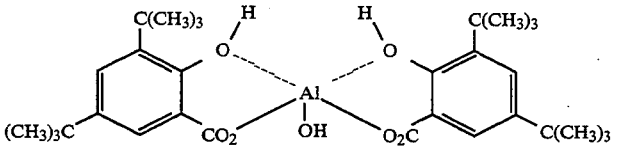

6. A negatively charging toner composition comprised of resin particles, pigment particles and a mixture of charge additive comprised of di-tertiary-butylsalicylic acid and a hydroxy aluminum complex charge enhancing additive of the formula as represented by

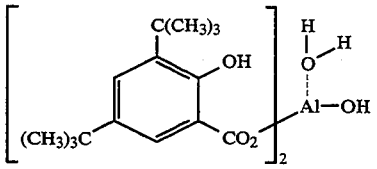

7. A toner composition in accordance with claim 1 wherein said alkylsalicyclic acid is selected from the group consisting of hydroxy bis[3,5-di-tert-butyl salicylic] aluminate, hydroxy bis[3,5-di-tert-butyl salicylic] aluminate monohydrate, hydroxy bis[3,5-di-tert-butyi salicylic] aluminate dihydrate, hydroxy bis[3,5-di-tert-butyl salicylic] aluminate tri or tetrahydrate and mixtures thereof.

8. A toner in accordance with claim 1 wherein the pigment is carbon black.

9. A toner in accordance with claim 1 wherein the pigment is cyan, magenta, yellow, or mixtures thereof.

10. A toner in accordance with claim 1 wherein the pigment is red, blue, green or brown.

11. A toner in accordance with claim 5 wherein the pigment is carbon black.

12. A toner in accordance with claim 5 wherein the pigment is cyan, magenta, yellow, red, blue, green brown, or mixtures thereof.

13. A toner in accordance with claim 1 wherein the charge additive mixture is present in an amount of from about 0.1 to about 20 weight percent.

14. A toner in accordance with claim 1 wherein the resin is a styrene acrylate, a styrene methacrylate, a polyester, or a styrene butadiene.

15. A toner in accordance with claim 5 wherein the resin is a styrene acrylate, a styrene methacrylate, a polyester, or a styrene butadiene.

16. A toner in accordance with claim 1 wherein the resin is a styrene butylmethacrylate, or a suspension polymerized styrene butadiene.

17. A toner in accordance with claim 6 wherein the resin particles are comprised of a styrene butylmethacrylate, or a suspension polymerized styrene butadiene.

18. A toner in accordance with claim 1 wherein the resin is present in an amount of from about 75 to about 95 weight percent.

19. A toner in accordance with claim 5 wherein the resin is present in an amount of from about 75 to about 95 weight percent.

20. A toner in accordance with claim 1 wherein the pigment is present in an amount of from about 0.5 to about 20 weight percent.

21. A toner in accordance with claim 5 wherein the pigment is present in an amount of from about 0.5 to about 20 weight percent.

22. A developer comprised of the toner of claim 1 and carrier particles.

23. A developer comprised of the toner of claim 5 and carrier particles.

24. A developer in accordance with claim 22 wherein the carrier is comprised of steel or ferrites.

25. A developer in accordance with claim 24 wherein the carrier contains a coating.

26. An imaging process which comprises (1) charging an imaging member in an imaging apparatus; (2) creating on the member a latent image comprising areas of high, intermediate, and low potential; (3) developing the low areas of potential with a first developer of claim 22; (4) developing the high areas of potential with a second developer comprising carrier and a second toner comprised of resin, pigment, and a charge enhancing additive that enables a positively charged toner; (5) transferring the resulting developed image to a substrate; and (6) fixing the image thereto.

27. An imaging process which comprises the generation of a latent image; developing the image with the toner of claim 1; transferring the image to a suitable substrate; and fixing the image thereto.

28. A toner in accordance with claim 1 containing surface additives selected from the group consisting of metal salts, metal salts of fatty acids, colloidal silicas, and mixtures thereof.

* * * * *